US006832165B2

(12) United States Patent
Stankus et al.

(10) Patent No.: US 6,832,165 B2
(45) Date of Patent: Dec. 14, 2004

(54) METHOD OF ROOF INSTABILITY RATING

(75) Inventors: John C. Stankus, Pittsburgh, PA (US); Yajie Wang, Pittsburgh, PA (US)

(73) Assignee: Jennmar Corporation, Pittsburgh, PA (US)

( * ) Notice: Subject to any disclaimer, the term of this patent is extended or adjusted under 35 U.S.C. 154(b) by 26 days.

(21) Appl. No.: 10/213,581

(22) Filed: Aug. 6, 2002

(65) Prior Publication Data

US 2003/0036851 A1 Feb. 20, 2003

Related U.S. Application Data

(60) Provisional application No. 60/310,654, filed on Aug. 7, 2001.

(51) Int. Cl.[7] ..... G01L 1/00; G01L 3/00; G01L 5/00

(52) U.S. Cl. ..... 702/43

(58) Field of Search ..... 702/34, 35, 41–43; 405/288, 302.1; 73/582, 594

(56) References Cited

U.S. PATENT DOCUMENTS

| | | | | | |
|---|---|---|---|---|---|
| 4,318,302 | A | * | 3/1982 | Choi | 73/761 |
| 4,686,849 | A | * | 8/1987 | Czirr | 73/38 |
| 5,425,601 | A | | 6/1995 | Calandra, Jr. et al. | |
| 5,542,788 | A | | 8/1996 | Stankus et al. | |
| 5,824,912 | A | | 10/1998 | Stankus et al. | |

* cited by examiner

*Primary Examiner*—Michael Nghiem
(74) *Attorney, Agent, or Firm*—Webb Ziesenheim Logsdon Orkin & Hanson, P.C.

(57) ABSTRACT

A method for predicting potential mine roof failures which generally includes the steps of identifying influence factors that affect mine roof instability, quantifying each influence factor, multiplying each influence factor by a numeric weight factor to obtain a weighed influence factor for each influence factor and calculating a mine roof instability rating based on the weighted influence factors. Supplemental support may be recommended in areas where the mine roof instability rating shows increased risk of mine roof failure.

20 Claims, 17 Drawing Sheets

METHOD OF ROOF INSTABILITY RATING

CROSS REFERENCE TO RELATED APPLICATIONS

This application claims the benefit of U.S. Provisional Patent Application Ser. No. 60/310,654, filed Aug. 7, 2001, entitled "Method of Rating Roof and Stability", which is incorporated herein by reference in its entirety.

BACKGROUND OF THE INVENTION

1. Field of the Invention

The present invention relates to ground control and, more particularly, to a mathematical analysis and prediction of mine roof stability.

2. Description of the Prior Art

Identification of potential roof problems in coal mines has long been a complex issue due to the wide variety of mining and geological conditions. If a mine roof unexpectedly collapses, there could be a loss of life and an immediate halting of the mining. In particular, longwall mining techniques may be susceptible to cave-ins, especially at intersections between entries and crosscuts.

Mine roof falls may be related to many different factors, such as roof strata properties, sandstone channels, regional and localized horizontal stress, vertical stress and tectonic stress. In many instances, roof stability is a combination of these factors that cause roof problems.

Accordingly, a need remains for a method of predicting stable and unstable areas in a mine roof that takes into account the various factors that cause roof problems and that can be applied to various environments.

SUMMARY OF THE INVENTION

In accordance with the present invention, there is provided a method for determining the stability of a mine roof failure generally including the steps of identifying relevant factors that affect mine roof stability, quantifying and weighing each relevant factor, and calculating a roof instability rating (RIR) value based upon the quantified relevant factors. Primary and supplemental support systems may be determined based on calculated RIR values.

The step of calculating a mine roof instability rating based on weighted relevant influence factors is done by utilizing the mathematical equation $RIR=\Sigma(W_i*FR_i)/\Sigma W_i$, where $W_i$ are the numeric weight factors that individually correspond to a single one of the influence factors and $FR_i$ are the influence factors.

The influence factors are generally identified from geological formation and stresses, including sandstone rating factors, immediate roof rating factors, surface topographic factors, stress factors. Sandstone factors may include sandstone thickness, interval between sandstone and seam, existence of mica in sandstone. Immediate roof factors may include type, strength, and thickness of strata that comprise the immediate roof. Surface topographic factors may include stream valley, linear. Stress factors may include regional horizontal stress, localized horizontal stress, mining-induced horizontal stress, tectonic stress and vertical stress. The step of quantifying the influence factors may be accomplished through a step selected from the group including a finite element model, evaluating a core sample and evaluating a surface topography map. The step of weighting each influence factor may be accomplished by multiplying each influence factor by a numerical value that represents the impact of the respective influence factor in overall roof stability. The role of the respective influence factors in overall roof instability may be determined by a step selected from the group including observing mine roof conditions, evaluating actual mine roof failures, determine mine roof composition, and applying knowledge gained from other mine roof failures.

DESCRIPTION OF THE PREFERRED EMBODIMENTS

Figure 1:
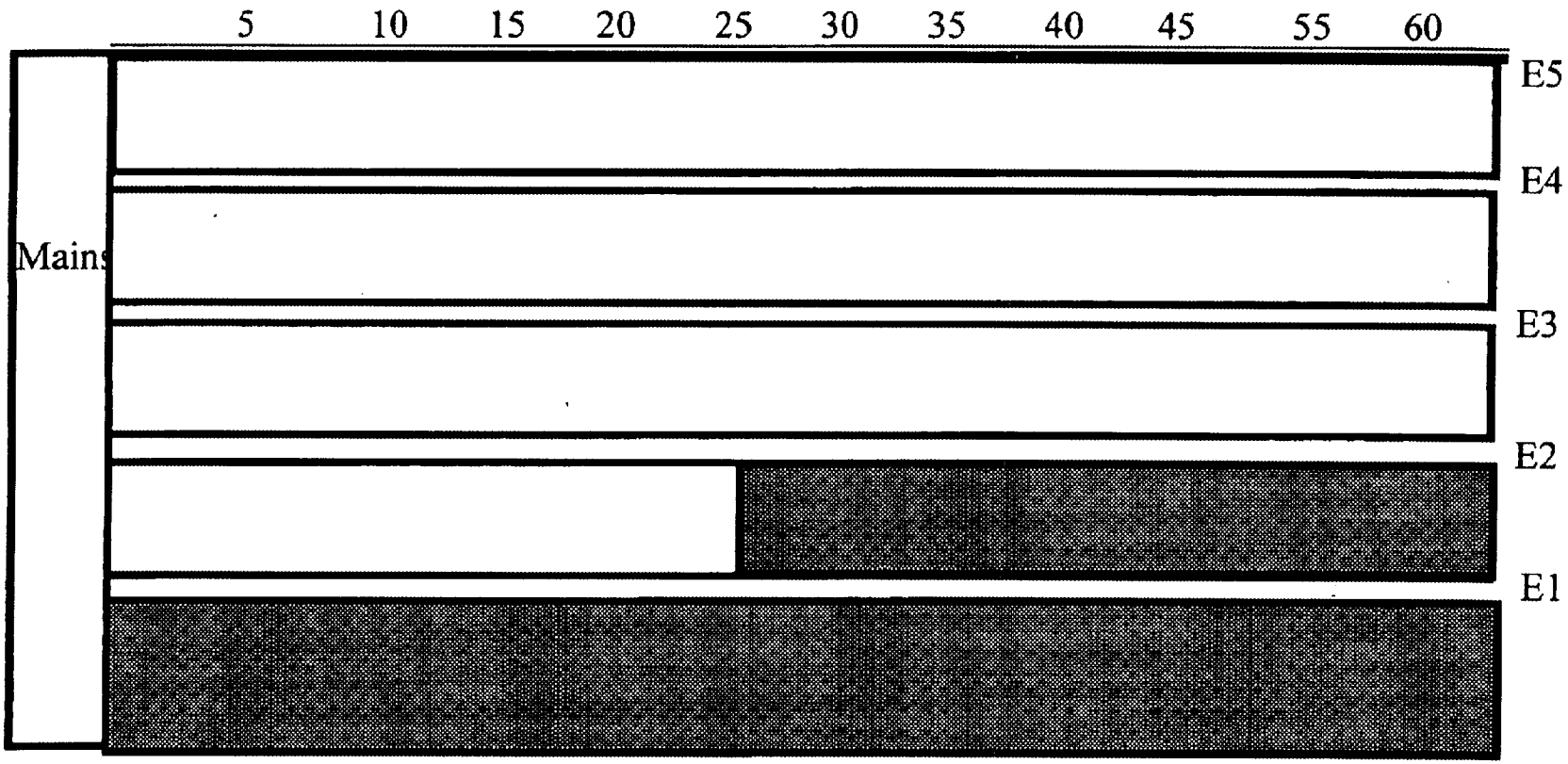
FIG. 1 is a schematic illustration of an E-panel layout at the mine of Example 1.

For the purposes of the description hereinafter, it is to be understood that the invention may assume various alternative variation step sequences, except where expressly specified to the contrary. It is also to be understood that the specific information illustrated in the attached drawings and described in the following specification, are simply exemplary embodiments of the invention.

In each embodiment of the present invention, a method to predict mine roof instability generally includes the steps of identifying relevant factors that affect mine roof instability, quantifying and weighing each relevant factor and calculating a roof instability rating (RIR) value based upon the quantified relevant factors. Primary and supplemental roof support may be determined based on calculated RIR values.

Roof instability factors are generally identified from naturally occurring geological formations or forces, man-made disruptions to naturally occurring geological formations or forces, or a combination of both. As described herein, roof instability factors generally include, but are not limited to, a sandstone factor which includes a mica analysis and an analysis of sandstone with shale streak, regional horizontal stresses, localized horizontal stresses, vertical stresses, a stream valley factor, tectonic stresses and a shale factor which includes an analysis of shale with sandstone streak, an analysis of interbedded shale with an analysis of sandstone with a shale streak sandstone, as well as other factors relating to roof instability.

These instability factors are given a factor rating ($FR_i$) ranging from zero to one hundred and are weighted according to weighting factors W_i to determine an RIR for a mine roof according to the formula:

$$RIR = \frac{\Sigma W_i * FR_i}{\Sigma W_i}$$

A first embodiment of the invention accounts for mine roof instability factors related to strata of sandstone and mica. Sandstone has a significant influence on roof stability. In the areas where sandstone exists, localized horizontal stress is usually experienced. Therefore, roof problems such as extensive cutter roof and roof falls are often encountered.

The degree of influence of the sandstone also depends on the sandstone thickness and proximity of sandstone to the coal seam. Generally speaking, the thicker the sandstone and closer the sandstone is to the seam, the more unstable the roof. Therefore, the influence of sandstone can be expressed as a sandstone rating (SR), wherein the sandstone rating (SR) is a function of sandstone thickness, T, and an interval I between the sandstone and seam.

Sandstone thickness, T, determines a sandstone thickness rating (STR) according to the equation:

$$STR=100*T/20$$

when T is less than or equal to about twenty feet, and STR=100, when T is at least about twenty feet. A higher STR indicates greater roof instability while lower STR indicates more roof stability.

The sandstone interval I determines a sandstone interval rating (SIR) according to the equation:

$$SIR=100*(20-I)/20$$

when the interval I is less than about twenty feet and SIR is zero when interval I is equal to or greater than about twenty feet. A higher SIR, indicates greater roof instability while lower SIR indicates more roof stability.

The sandstone rating is then determined by the equation:

$$SR=(STR*SIR)^{1/2}.$$

Each of STR, SIR and SR is a value ranging from zero to one hundred. Low SR indicates a more stable roof while a high SR indicates roof instability.

The presence of mica in mine roof strata, and particularly in the sandstone, makes the sandstone more prone to delamination. Mica, which is difficult to detect in normal stratascoping, also weakens the sandstone. In the area where the mica exists, a mica rating (MR) is set at one hundred. When mica is not present, the mica rating (MR) is set to zero.

Stream valleys located above a mine roof can also cause localized horizontal stress. A stream valley influence zone, can be determined by core analysis or geological mapping. When a mine roof is within the stream valley influence zone, a stream valley rating (SIR) is set to one hundred. Conversely, when the mine roof is not located within the stream valley influence zone, the stream valley rating is assigned a zero value.

Tectonic stress is the stress induced by a geological structure such as a syncline, an anticline, and a seam evaluation change. A tectonic stress influence zone can be determined by finite element analysis as described in U.S. Pat. No 5,542,788 which is incorporated herein by reference in its entirety. Areas of the mine roof that are located within the tectonic stress influence zone are assigned a tectonic stress rating (TSR) of one hundred, and a zero value is assigned if the mine roof is not located within the tectonic stress influence zone.

The roof instability rating (RIR) is calculated according to the following equation:

$$RIR = \frac{(W_1 * SR) + (W_2 * MR) + (W_3 * SVR) + (W_4 * TSR)}{W_1 + W_2 + W_3 + W_4}$$

where $W_1$–$W_4$ are weighting factors. Generally speaking, the sandstone rating (SR) plays more of a role in roof instability. Therefore, $W_1$ generally is assigned the value of two when sandstone is present. The $W_2$, $W_3$, and $W_4$ weighting factors are generally assigned a unity value, but may be assigned higher numerical values depending on the particular mine roof strata being evaluated. Weighting factors are generally also used to adjust the measured data based upon previously observed roof falls, roof falls at other mines having similar strata conditions, or other reasons based upon experience. The RIR value ranges from zero to one hundred with a high RIR value indicating a higher probability of mine roof failure. For this embodiment, in general, an RIR of at least about 60, indicates a high probability of roof failure warranting use of supplemental support in longwall mining. An RIR of about 50 to less than about 60 is considered to indicate an intermediate level of longwall mine roof stability for which supplemental support may be appropriate during longwall retreat. An RIR of about less than 50 is considered to indicate a stable longwall mine roof with no supplemental support needed.

The relationship between RIR and longwall mine roof stability may vary from the aforementioned values which are not meant to be limiting. Experience may reveal that other RIR limits may be set for determining instability, intermediate stability, or stability for longwall mine roofs or for mine roofs established using other mining practices.

EXAMPLE I

This example reflects actual data collected from a coal seam in a mine in Pennsylvania. The mine roof at the mine generally includes laminated shale with coal streaks. In the seam, sandstone had a significant influence on roof stability. In areas where sandstone exists, localized horizontal stress is usually experienced and mine roof problems are often encountered.

As shown in FIG. 1, panel E-1 of the mine was mined out and panel E-2 was retreating. An E-3 panel gate-road was being developed, and roof problems were experienced during development, particularly between cross-cuts 15–20.

Figure 2:
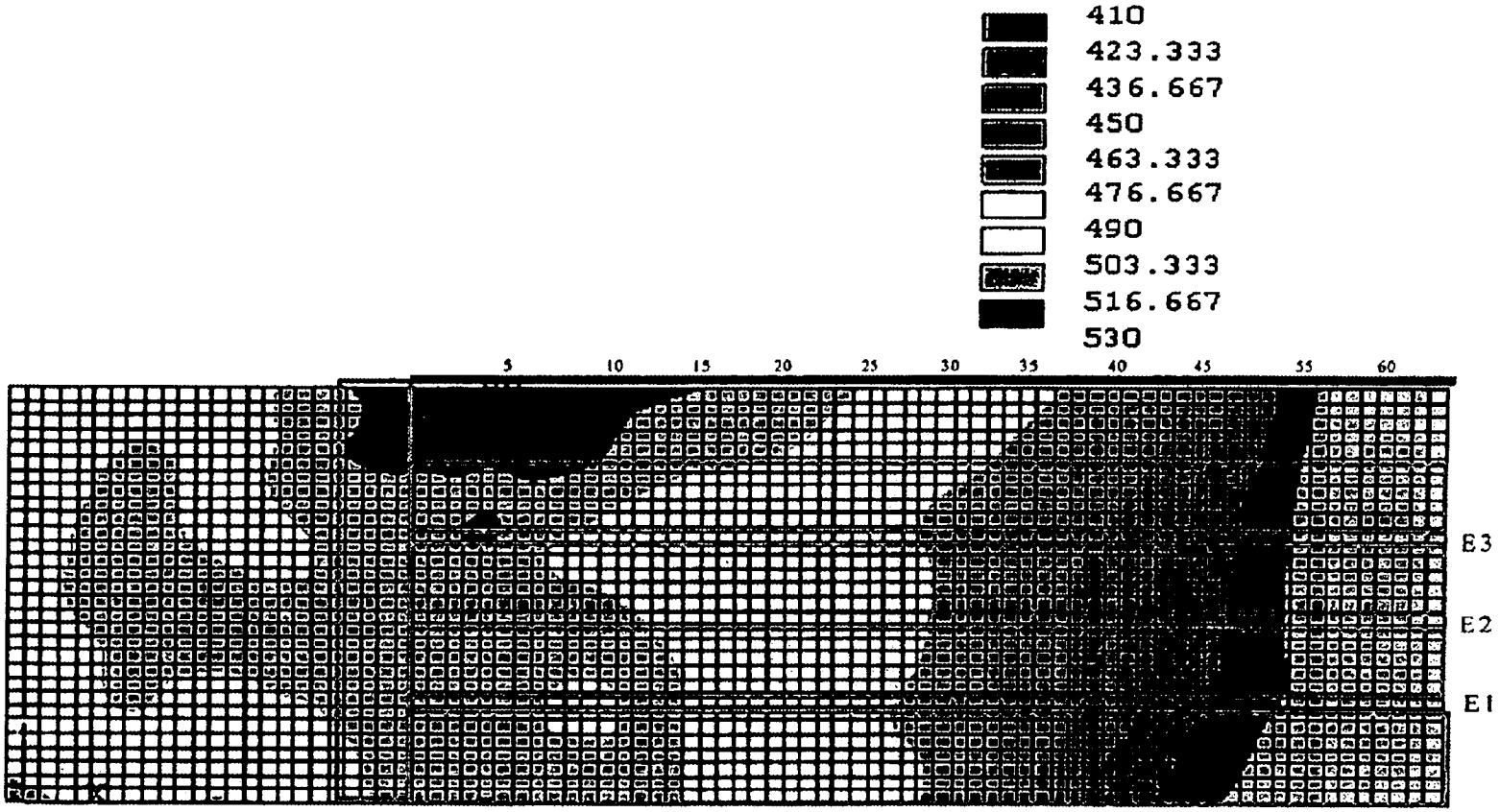
FIG. 2 is a quantitative finite element model constructed to aid in determining tectonic stress at the mine of Example 1.
Figure 3:
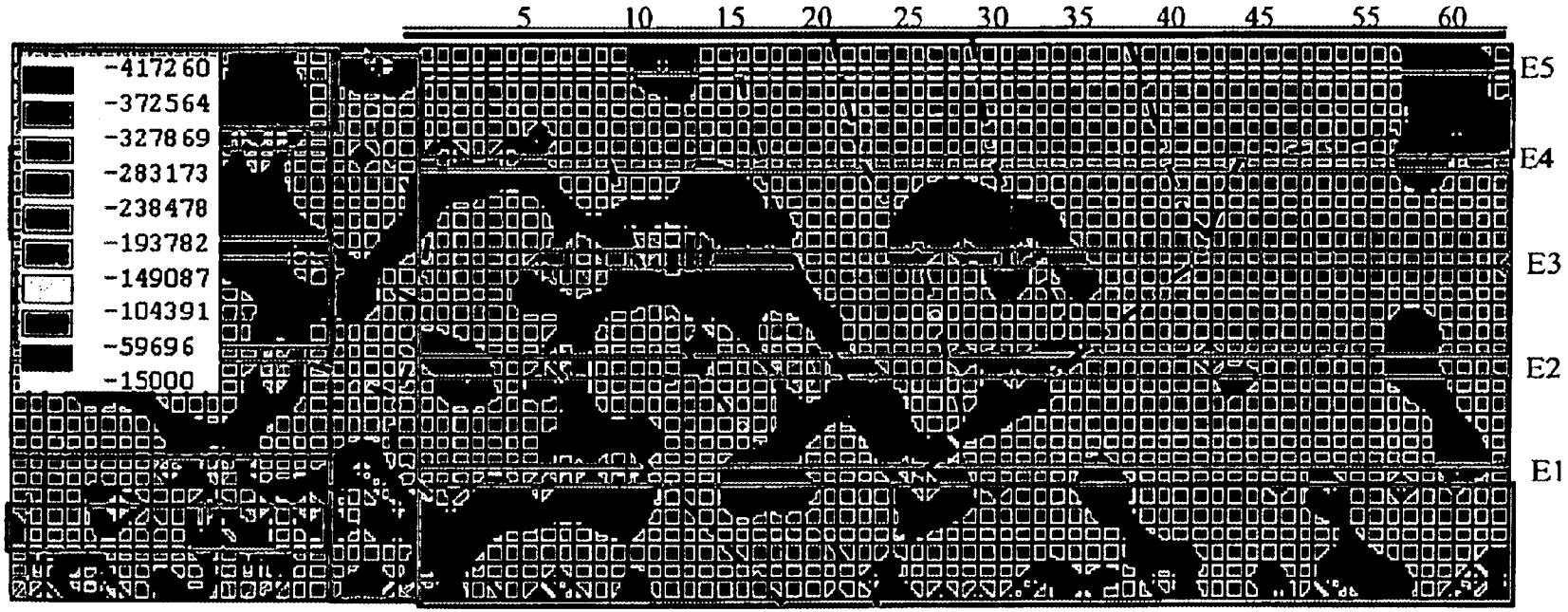
FIG. 3 is a quantitative mapping of the tectonic stress and its influences area at the mine of Example 1.

The RIR according to the present invention was applied to unmined panels E-3 through E-5. Tectonic stress analysis for all of the panels, as shown in FIG. 2, was constructed by generating a finite element model and then introducing seam elevation. FIG. 3 shows the tectonic stress and its influence areas.

Beginning with panel E-3, RIR was calculated based upon the tectonic stress modeling shown in FIGS. 2 and 3, drill hole logs, and an extensive underground examination of the mine roof in panel E-3. At the time of the examination, the E-3 panel was developed to cross-cut 25. Based upon the factors discussed in detail above, particularly the sandstone rating, tectonic stress rating, mica rating, and the stream valley rating, the RIR mathematical representation shown in FIG. 4 was generated for panel E-3. It was concluded that cross-cuts 17–22 each had a relatively high RIR, about 60 or more, and this cross-cut area had experienced several roof falls. Cross-cuts 4–9, 12–17, and 27–32 scored an intermediate RIR value, about fifty to sixty and did not experience any roof falls. In the remainder of the cross-cuts, the RIR value was low, i.e. less than about fifty.

Figure 4:
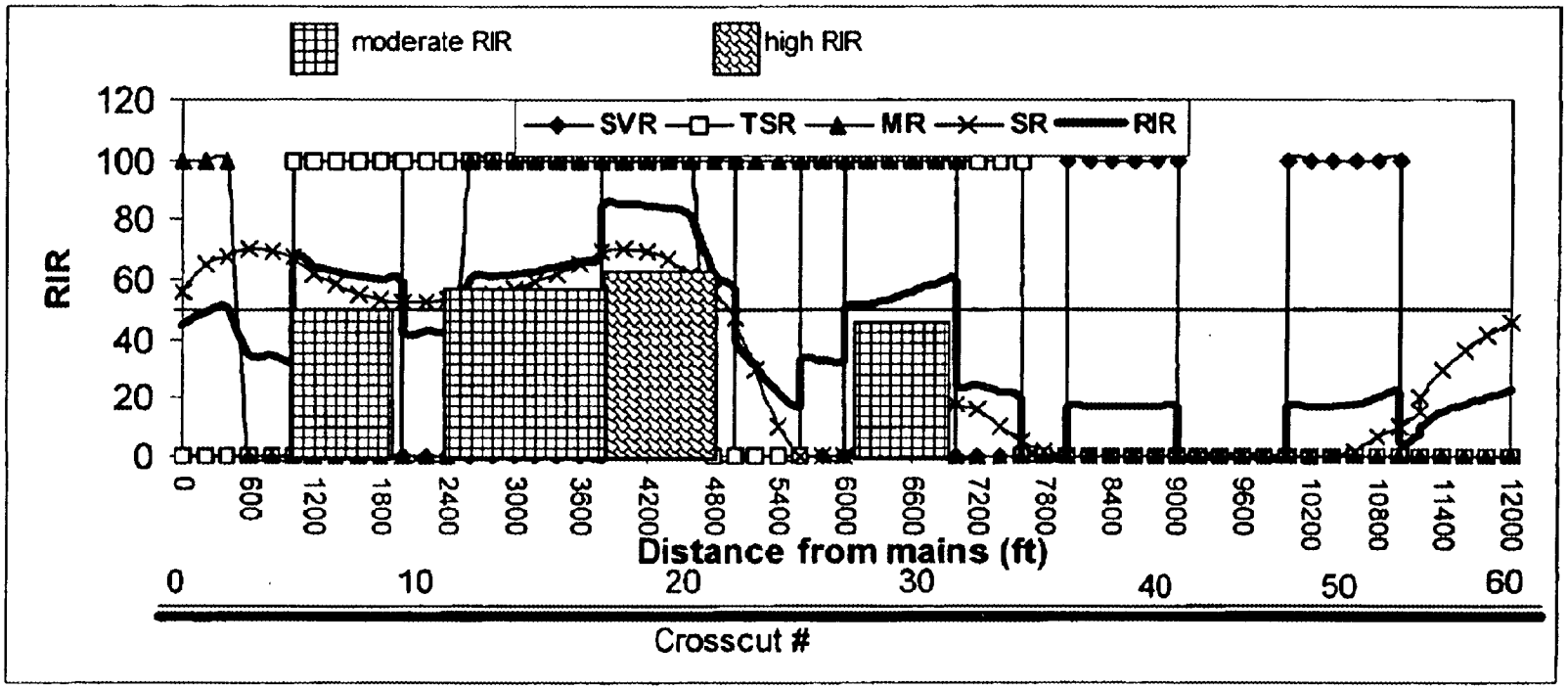
FIG. 4 is a quantitative graph of a generated RIR for E3.

Based on the calculated RIR values for the E-3 panel shown in FIG. 4, supplemental support such as cable bolts or trusses was not installed in the low RIR value areas, except at intersections. Supplemental support was not installed in the intermediate RIR value areas prior to longwall retreat. In the high RIR value areas, supplemental support was installed. Subsequently, as predicted by the present invention, mine roof failure occurred in the intermediate RIR value areas during longwall retreat which could have been avoided had supplemental support been installed therein.

Figure 5:
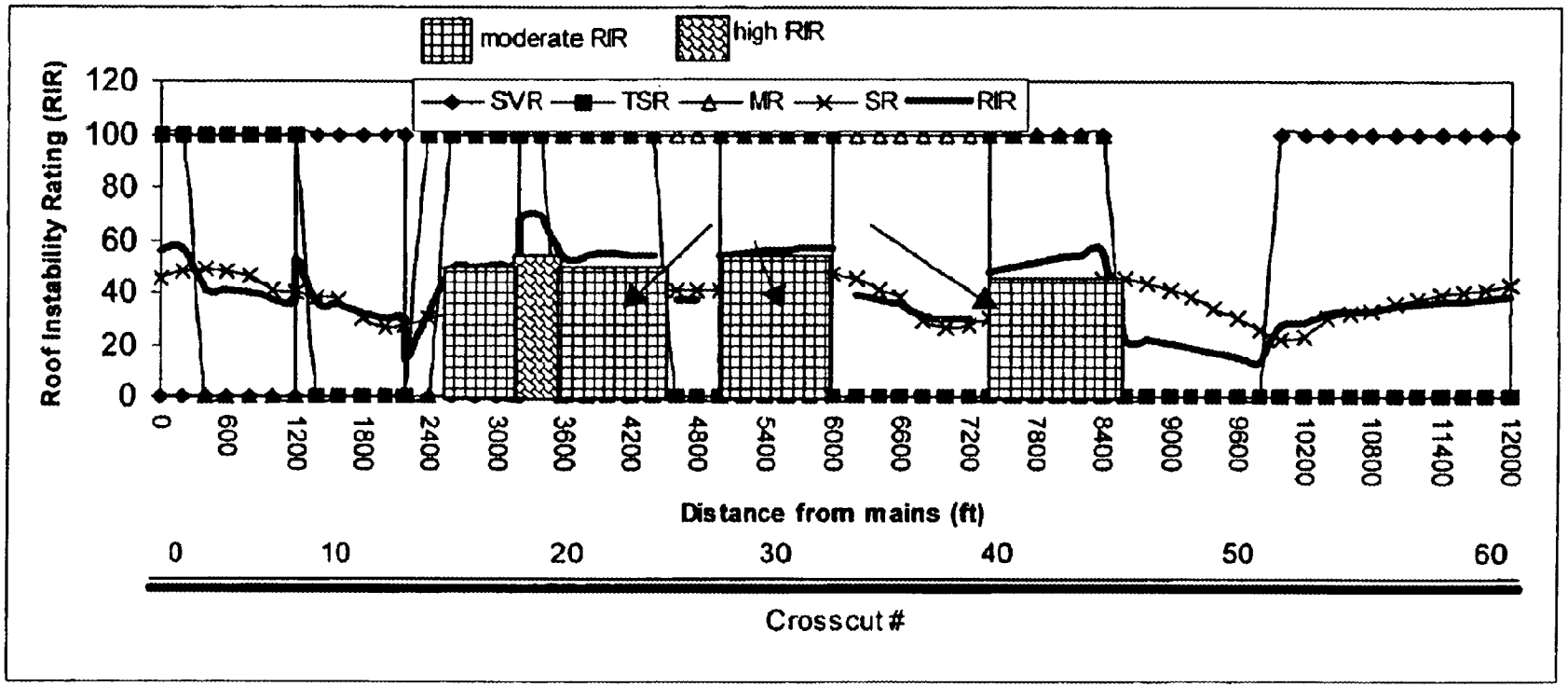
FIG. 5 is a quantitative graph of a generated RIR for E4.

FIG. 5 illustrates the calculated RIR for panel E4. The RIR may be summarized as follows. Crosscuts 17–19 had a high RIR value of about sixty. Roof problems were expected in this high RIR value area during entry development and support was installed as soon as possible. In crosscuts 15–17, 19–23, 26–31, and 39–45, the RIR was about fifty to about sixty. In these moderate RIR value areas, supplemental support was installed before longwall retreat. In the remaining low RIR value areas, only supplemental support was recommended at intersections. No roof problems were encountered.

Figure 6:
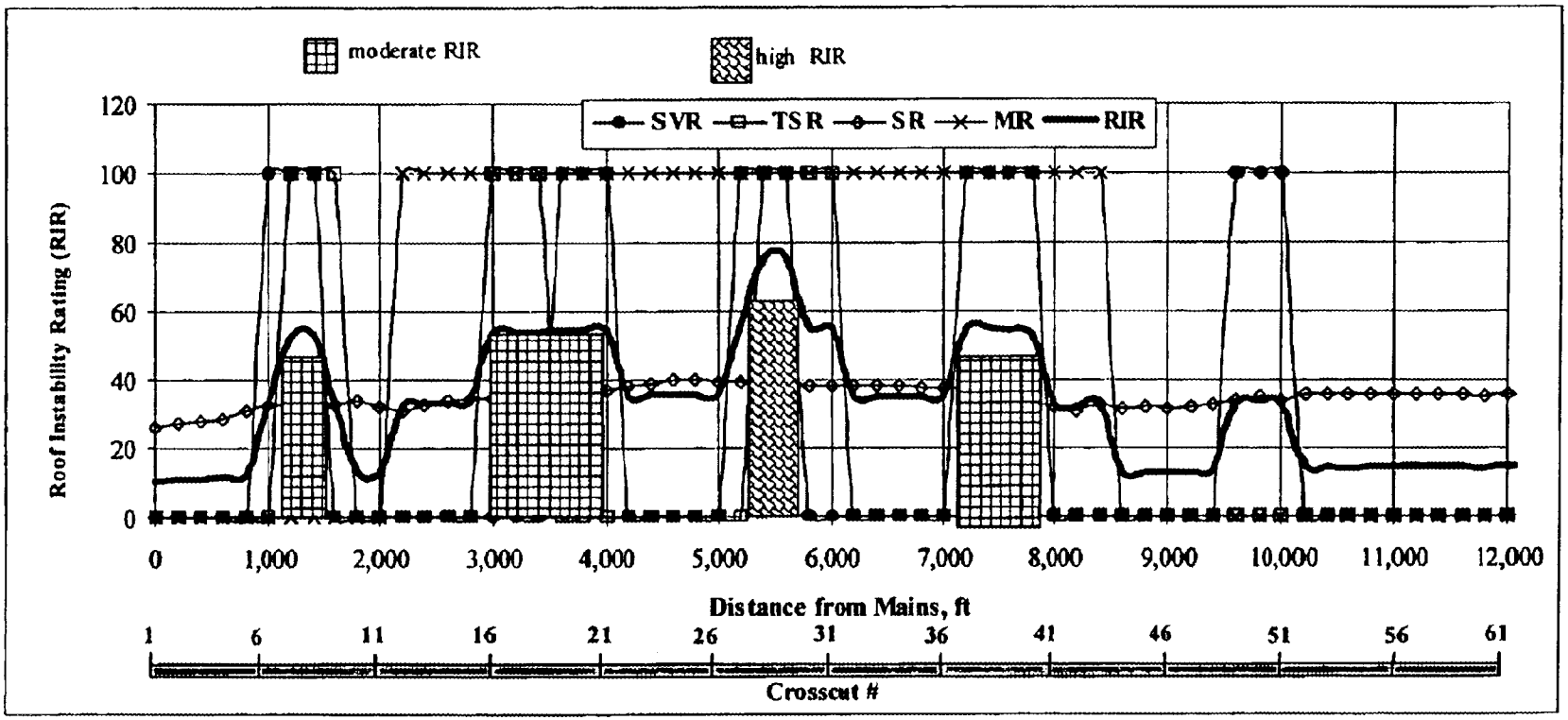
FIG. 6 is a quantitative graph of a generated RIR for E5.

FIG. 6 illustrates the RIR values for the E5 panel. This panel was still under development during the evaluation of the remaining panels, but the same analysis was used to determine the need for supplemental support for panels E-3 and E-4 was used to determine the need for immediate supplemental support at cross-cuts 27–30 and longwall retreat supplemental support at cross-cuts 7–8, 16–21, and 37–39.

Based on the successful RIR in the E-panels, an RIR coarse model was constructed for projected F-panels. The coarse model was based on drill hole data and other available information. The following is the RIR analysis for part of the F-panels based on the known information.

Figure 7:
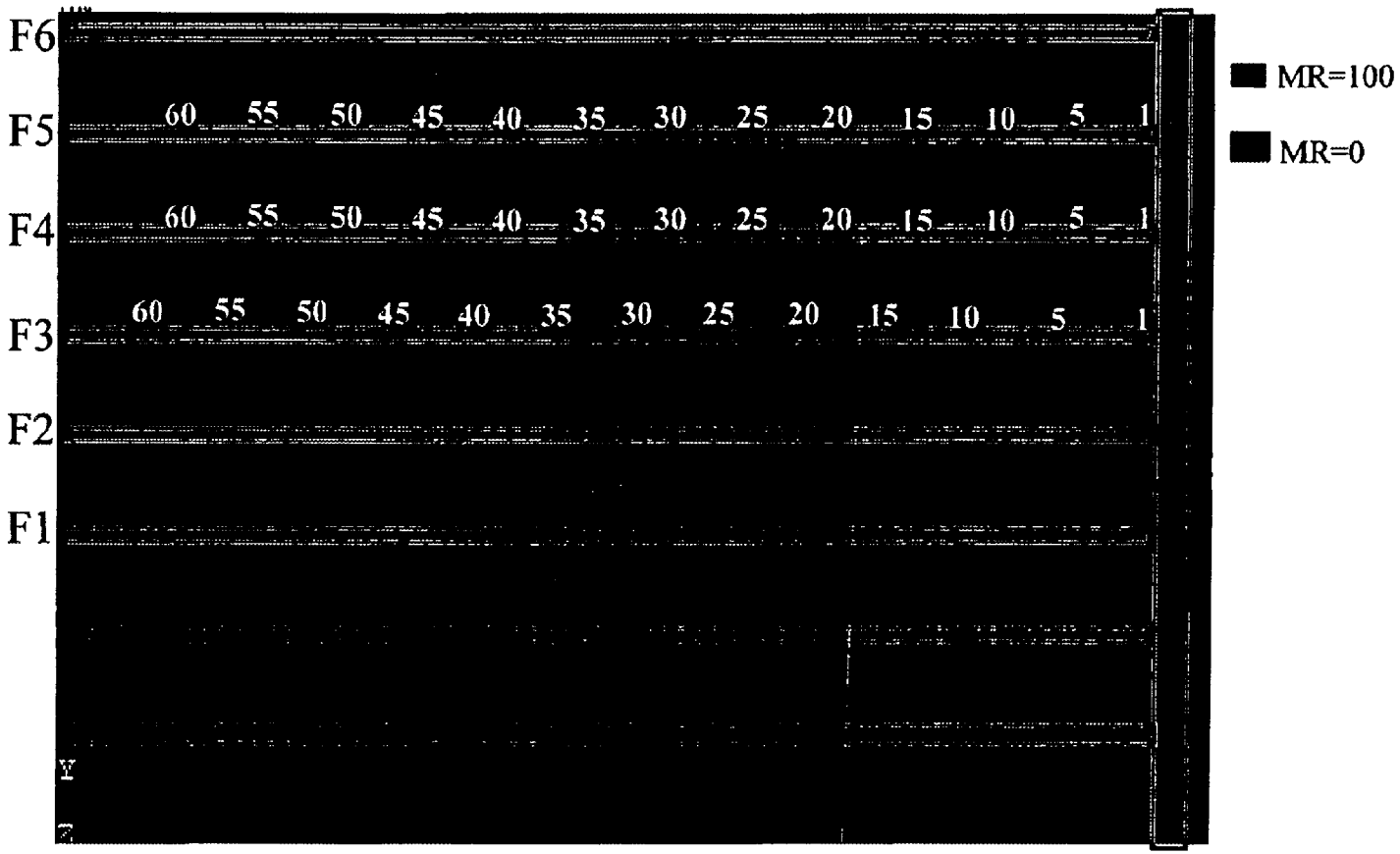
FIG. 7 is a quantitative mapping of mica rating distribution for F-panels.
Figure 8:
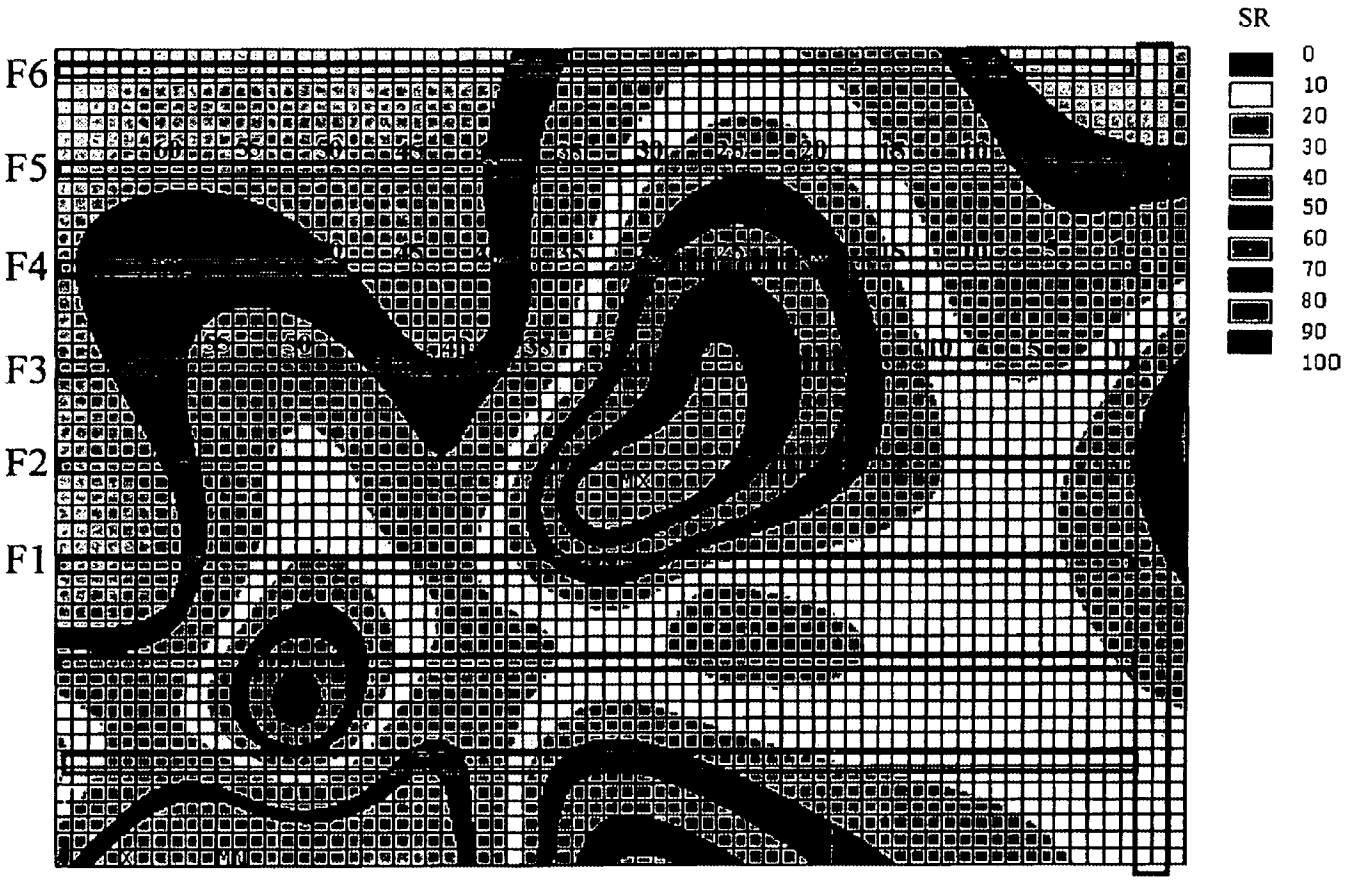
FIG. 8 is a quantitative mapping of a sandstone rating for F-panels.

Based on the drill hole logs and underground stratascoping data, the mica rating (MR) distribution is shown in FIG. 7 and corresponding sandstone rating (SR) distribution for the F-panels is shown in FIG. 8. Mica values are either zero (no mica present) or one hundred (mica present). The sandstone ratings (SR) were calculated by the formulas discussed above.

Figure 9:
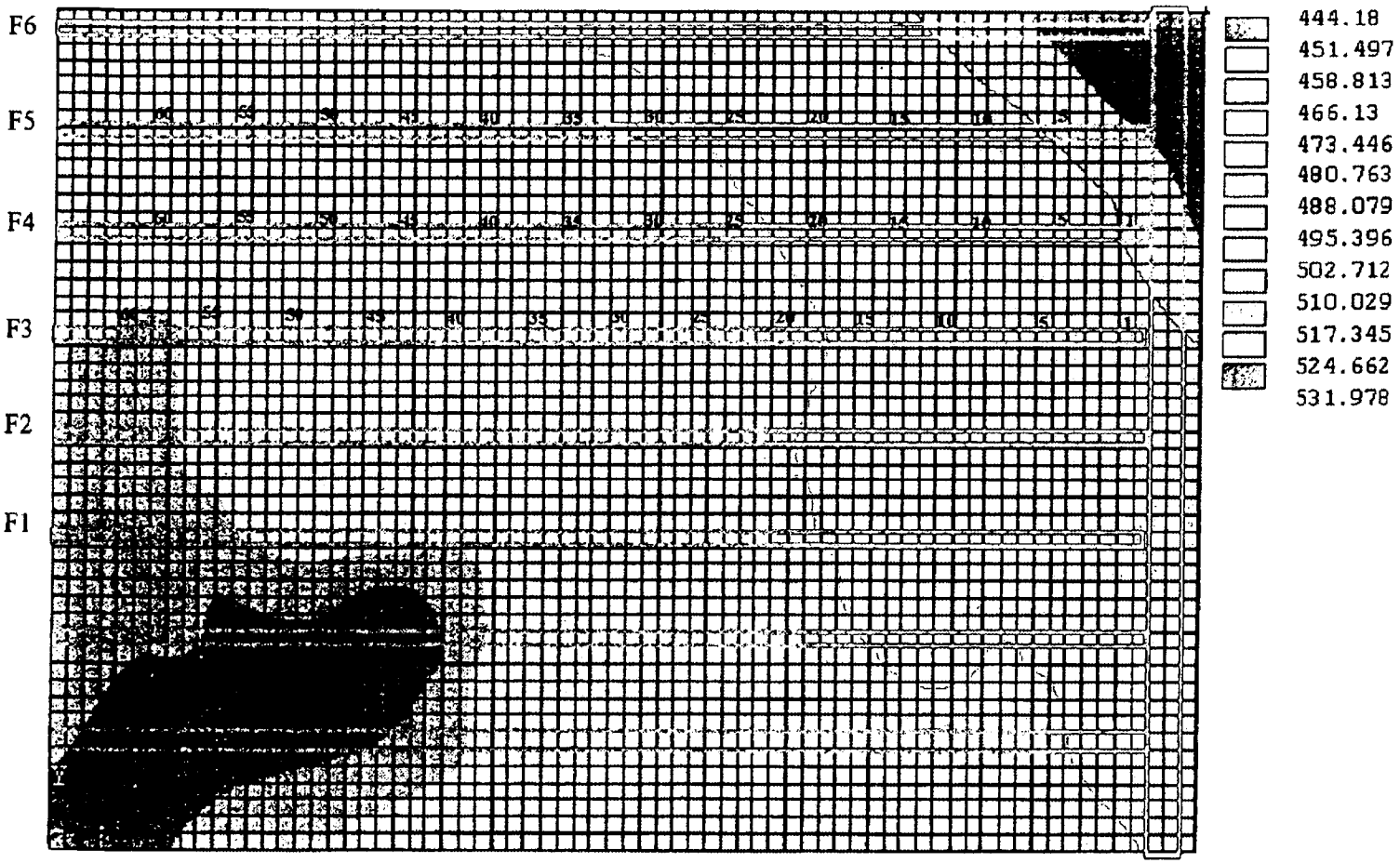
FIG. 9 is a finite element model with input seam elevation.
Figure 10:
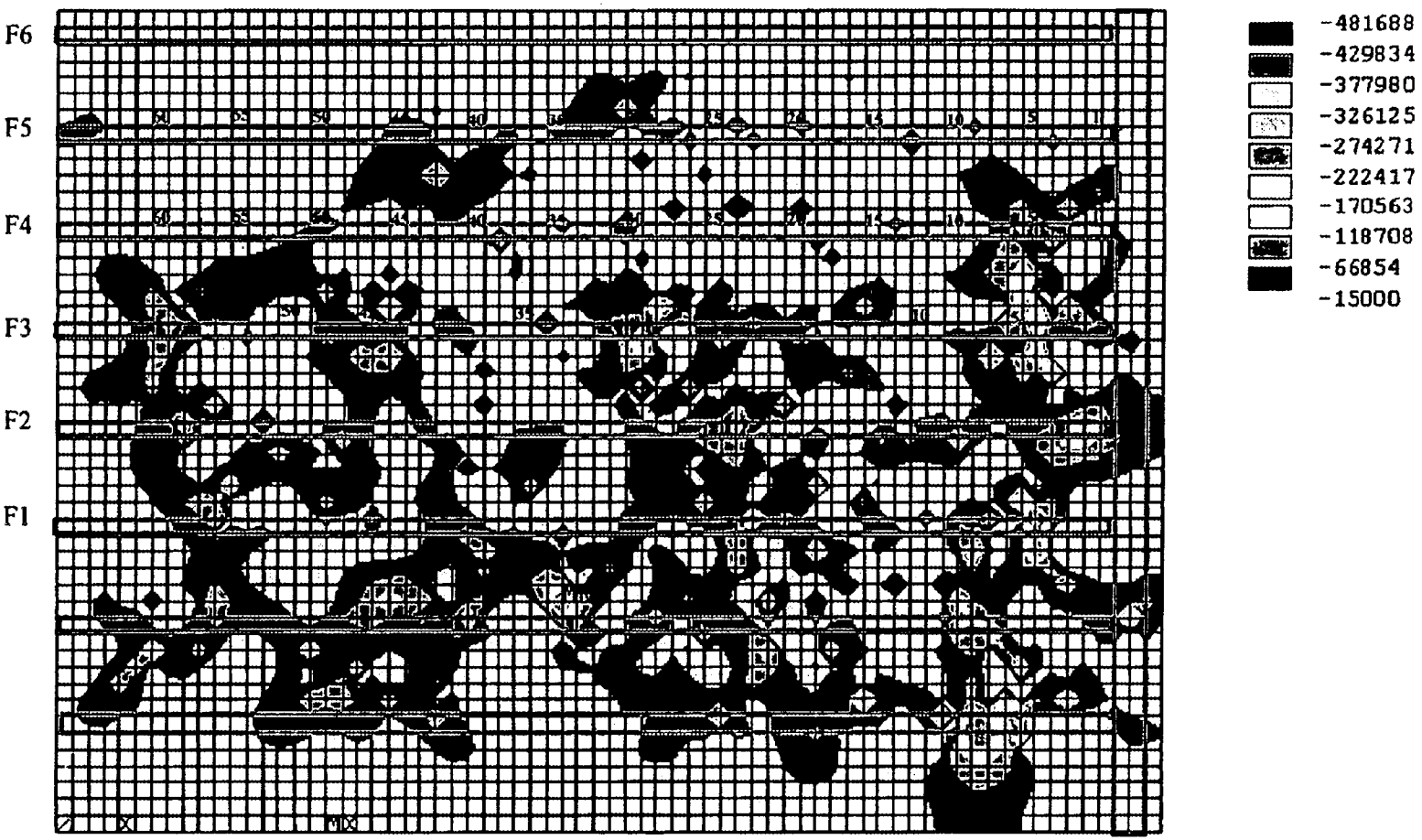
FIG. 10 is a quantitative mapping of tectonic stress distribution and influence areas.

FIG. 9 is a finite element model with input seam elevations. FIG. 10 shows the tectonic stress distribution and influence areas.

Figure 11:
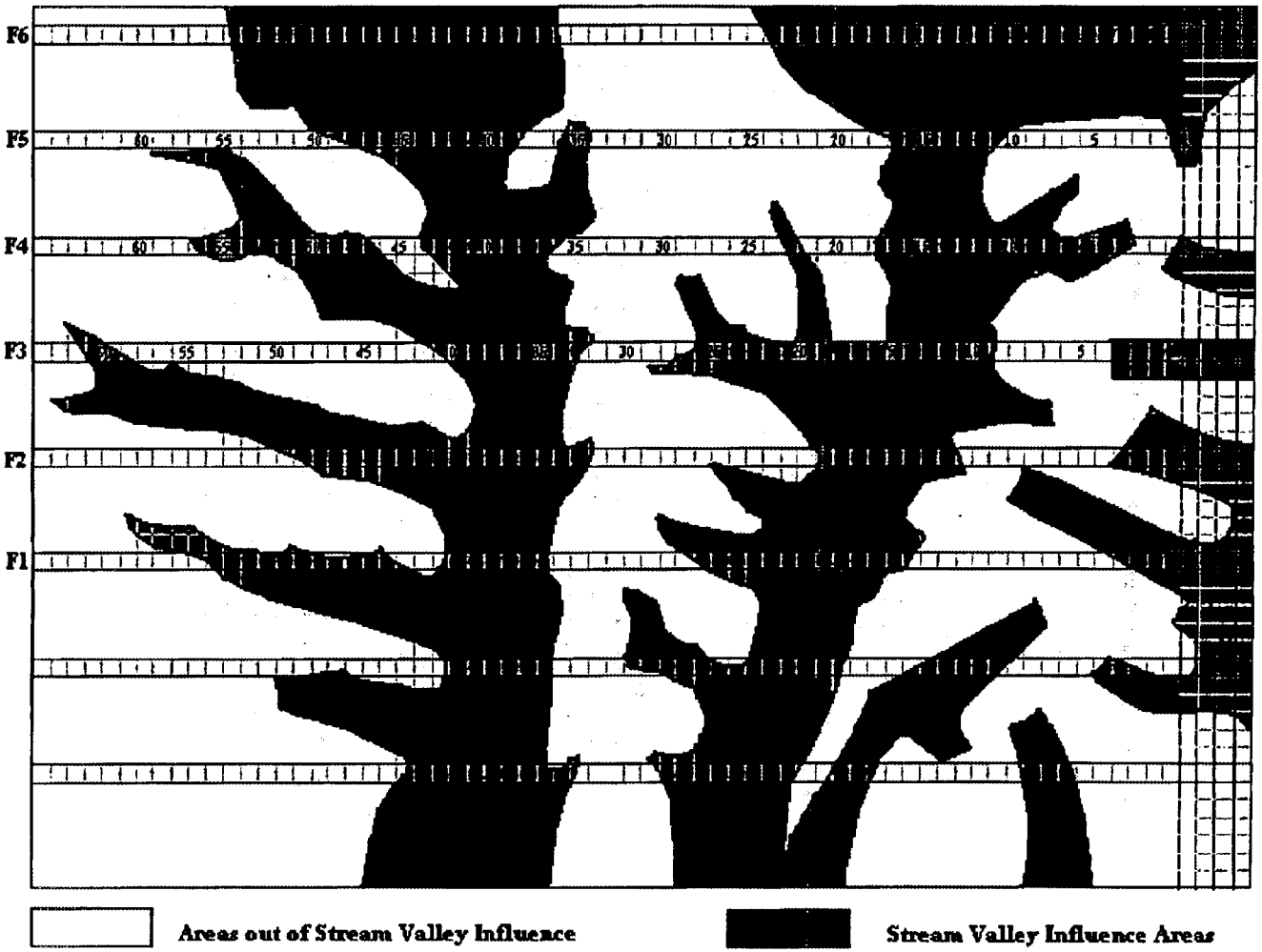
FIG. 11 is a quantitative mapping of stream valleys and influence zones based on a surface topography map.

The stream influence zone is five hundred feet from the valley bottom. Based on the surface topography map, stream valleys and related influence zones are shown in FIG. 11.

Figure 12:
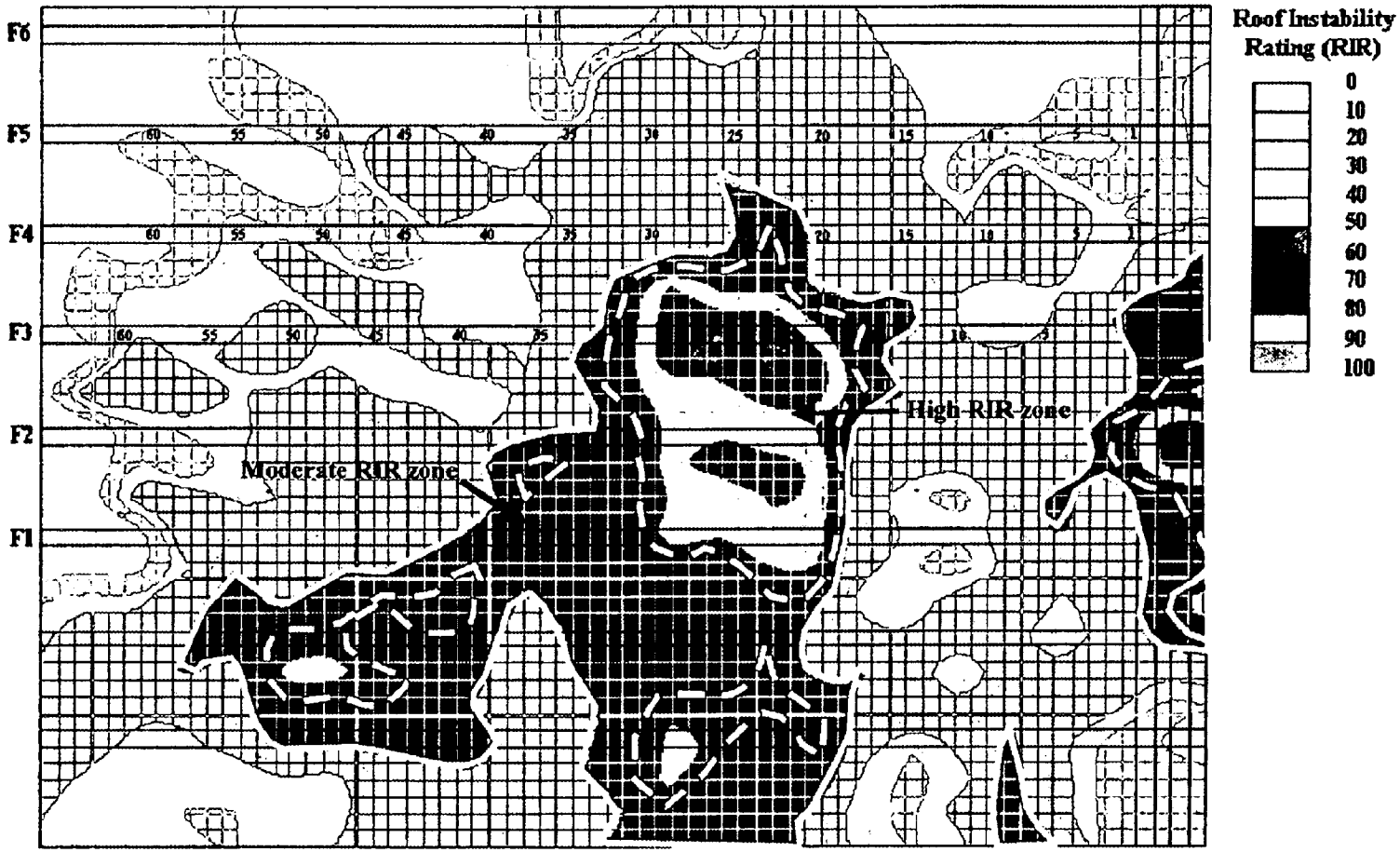
FIG. 12 is a quantitative graph of a generated RIR value for F-panels.

By combining the tectonic stress rating, the stream valley rating, the sandstone rating, and the mica rating, the RIR for the F-panels is shown in FIG. 12. Three distinctive zones, high, medium, and low RIR zones are identified in FIG. 12. Supplemental support, such as cable bolts and trusses were immediately installed in the high RIR areas. Supplemental support in the moderate RIR areas was installed before the longwall retreats. The F3 and F4 panels were successfully supported without any roof falls.

A second embodiment invention accounts for mine roof instability factors related to strata of shale, shale with sandstone streaks or mica, inter-bedded shale with sandstone, and sandstone with shale streaks. Solid sandstone is rare. The thickness and location of each type of strata have varying effects on roof stability. Shale is the most stable roof. Sandstone with shale streaks is the most unstable roof. In this embodiment, RIR is calculated by the equation:

$$RIR = \frac{W_1 * SHR + W_2 * SHWSSR + W_3 * ISHWSSR + W_4 * SSWSHSR}{(W_1 + W_2 + W_3 + W_4)}$$

where SHR is a shale rating, SHWSSR is a shale with sandstone streak rating, ISHWSSR is an interbedded shale with sandstone rating, and SSWSHSR is a sandstone with shale streaks rating. Weighting factors $W_1$–$W_4$ are determined from observed phenomenon and experience evaluating mine roof strata. For this embodiment of the invention, an RIR of greater than 35 indicates roof instability warranting use of supplemental support. No supplemental support is needed for an RIR of about 35 or less in this embodiment. Again, these limits are exemplary only and others may be set based on experience.

The effect of shale on roof stability depends on its thickness and proximity to the immediate roof line. Shale that is thick and close to the roof line provides a more stable roof. Therefore, the shale rating (SHR) includes two parts: a thickness and an interval between the shale and roof line. A shale thickness rating (SHTR) is defined as:

$$SHTR=100*(10-T)/10$$

where T is shale thickness. The value of SHTR ranges from zero to one hundred, with a higher SHTR indicating a more unstable roof. A shale interval rating (SHIR) is defined as:

$$SHIR=100*I/10$$

where I is the interval between the shale and roof line. The value of SHIR ranges from zero to one hundred with higher SHIR indicating a more unstable roof.

The shale rating (SHR) is defined as:

$$SHR=((3*SHTR)+SHIR)/4.$$

The value of SHR ranges from zero to one hundred with higher SHR indicating a more unstable roof.

Sandstone streaks not only make the shale more easily delaminated but also store more energy in the mine roof. The release of this energy usually causes strata delamination and roof cutter. Shale with sandstone streaks that is thick and close to the roof line creates an unstable roof. Therefore, the SHWSSR includes two parts: thickness and interval. A thickness rating (TR) is defined as:

$$TR=100*T/10$$

where T is the thickness of shale with sandstone streaks. The value of TR ranges from zero to one hundred with higher TIR indicating a more unstable roof. An interval rating (IR) is defined as:

$$IR=100*(10-I)/10$$

where I is the interval to the roof line. The value of IR ranges from zero to one hundred with higher IR indicating a more unstable roof.

Figure 14:
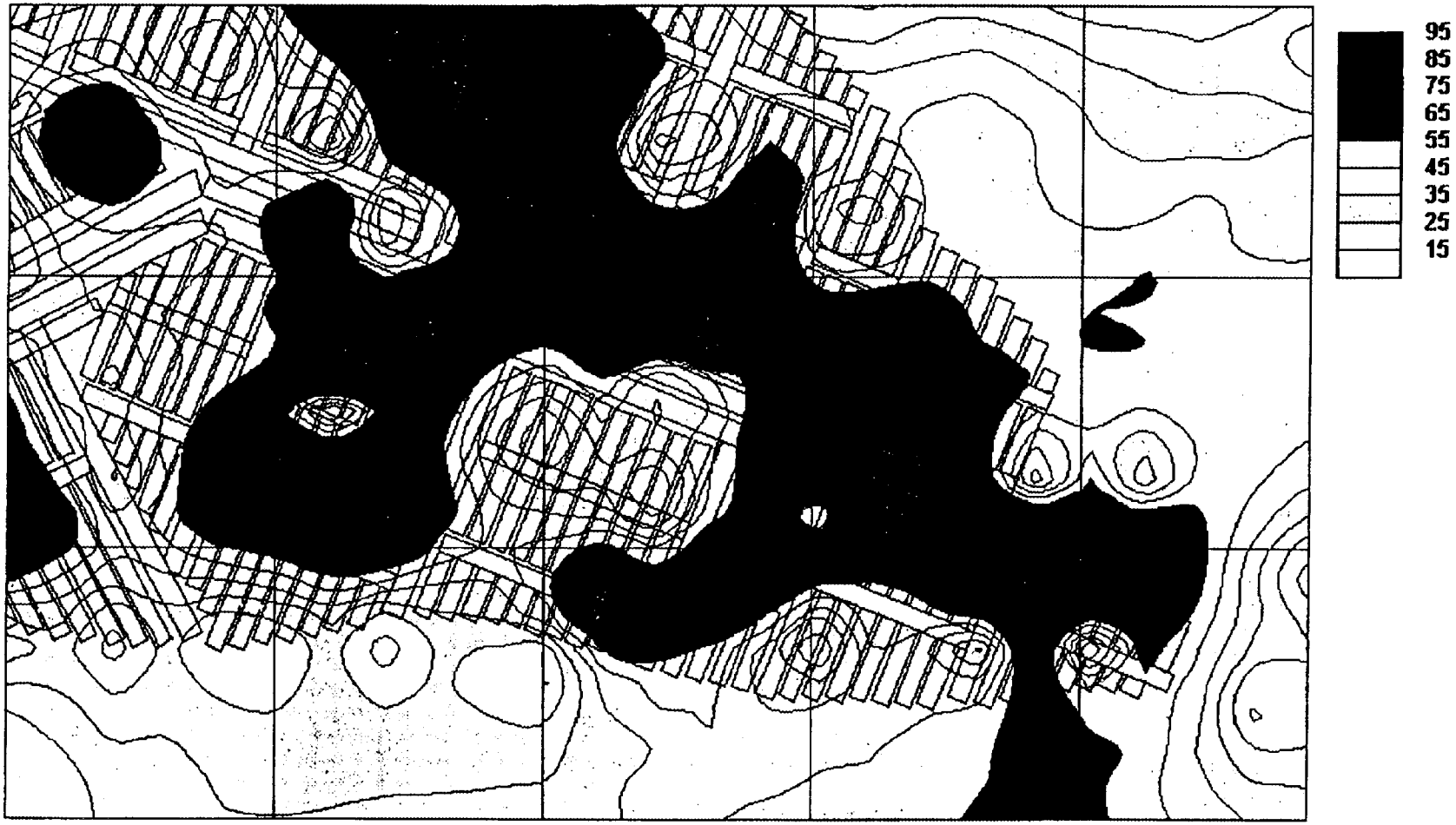
FIG. 14 is quantitative mapping of shale with sandstone streak rating.

A shale with sandstone streak rating (SHWSSR) is defined as:

$$SHWSSR=(TR*IR)/2$$

wherein the value of SHWSSR ranges from zero to one hundred with higher SHWSSR indicating a more unstable roof. The SHWSSR is shown in FIG. 14. It can be seen that most of the roof falls were in the high rating area.

Interbedded shale with sandstone stores more energy than the shale with sandstone streaks and can be easily delaminated. Further, localized horizontal stress usually exists in this type of material. The release of this energy will cause strata delamination and roof cutter. Shale with sandstone streaks that is thick and close to the roofline creates an unstable roof. Therefore, the interbedded shale with sandstone rating (ISHWSSR) includes two parts: thickness and interval. The thickness rating (TR) is defined as:

$$TR=100*T/10$$

where T is the thickness of shale with sandstone streaks. The value of TR ranges from zero to one hundred with higher TR indicating a more unstable roof. The interval rating is defined as:

$$IR=100*(10-I)/10$$

where I is the interval to the roof line. The value of IR ranges from zero to one hundred with higher IR indicating a more unstable roof. The interbedded shale with sandstone rating is defined as:

$$ISHWSSR=(TR*IR)^{1/2}.$$

The value of ISHWSSR ranges from zero to one hundred with higher ISHWSR indicating a more unstable roof.

Sandstone with shale streaks (SSWSHSR) strata stores the most energy as compared to the previous types. It easily delaminates at the shale streak bedding planes. Localized horizontal stress usually exists in this type of strata. The release of this energy can cause strata delamination and roof cutter. Sandstone with shale steaks that is thick and close to the roofline, creates an unstable roof. Therefore, this rating also includes two parts: thickness and interval. The thickness rating (TR) is defined as:

$$TR=100*T/10$$

where T is the thickness of shale with sandstone streaks. The value of TR ranges from zero to one hundred with the higher TR indicating a more unstable roof. The interval rating (IR) is defined as:

$$IR=100*(10-I)/10$$

where I is the interval to the roof line. The value of IR ranges from zero to one hundred with higher IR indicating a more unstable roof.

EXAMPLE 2

The second embodiment of the invention was used to calculate RIR for another coal seam having an overburden depth generally ranging from 400–500 feet. At the time of the underground examination, many roof falls had occurred with more than one half of the roof falls occurring in intersections. A stratascope examination was conducted of a borehole with the following observations:

9'–6'6" laminated sandy shale

6'6"–5 laminated sandy shale with dark streaks

5'–1'4" laminated shale with dark bands

1'4"–0 dark shale with fossilized material

No bedded sandstone or streaks were detected. However, excessive rib sloughage was observed in the high coal areas.

Figure 13:
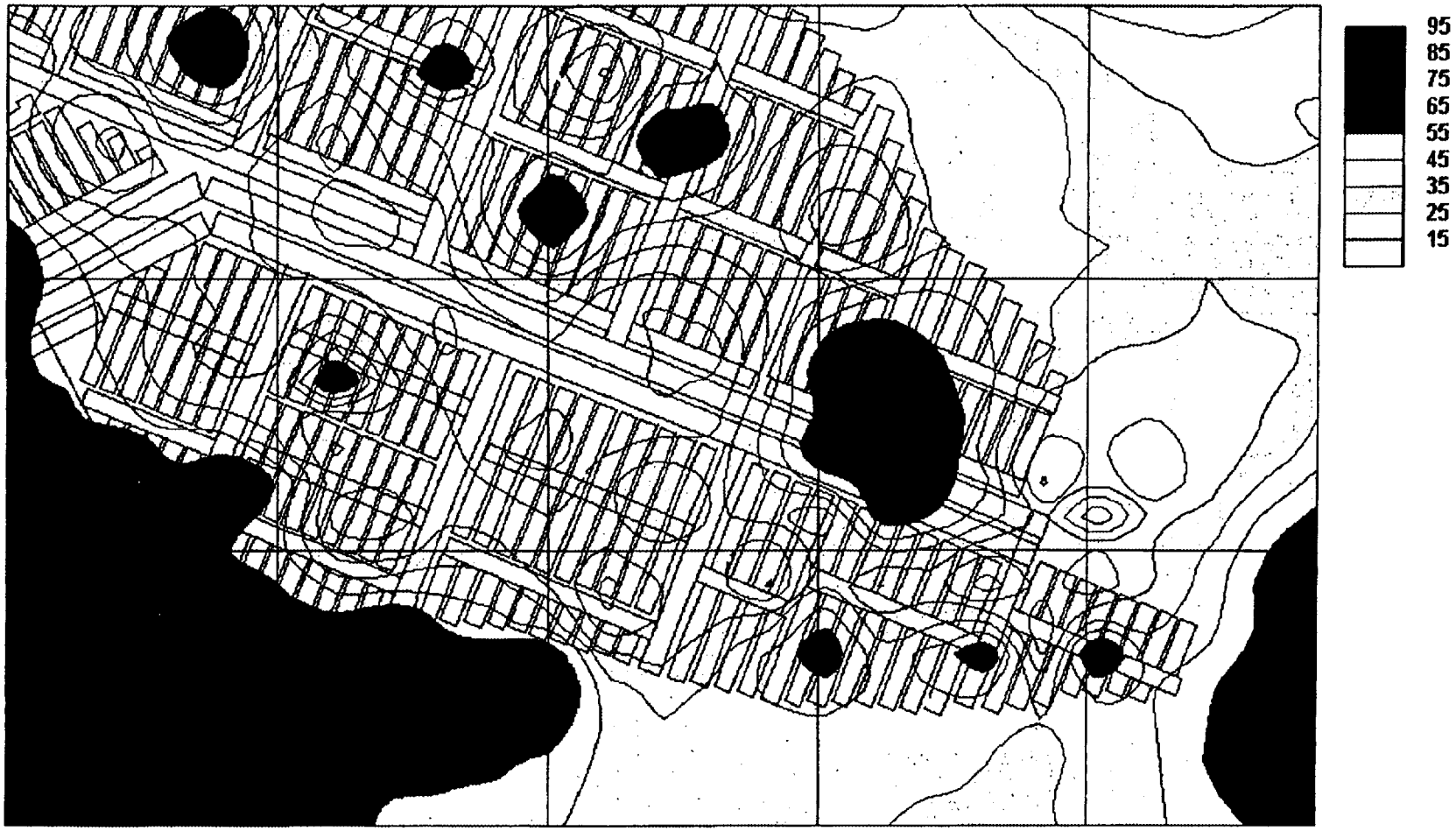
FIG. 13 is a quantitative mapping of a shale rating.
Figure 15:
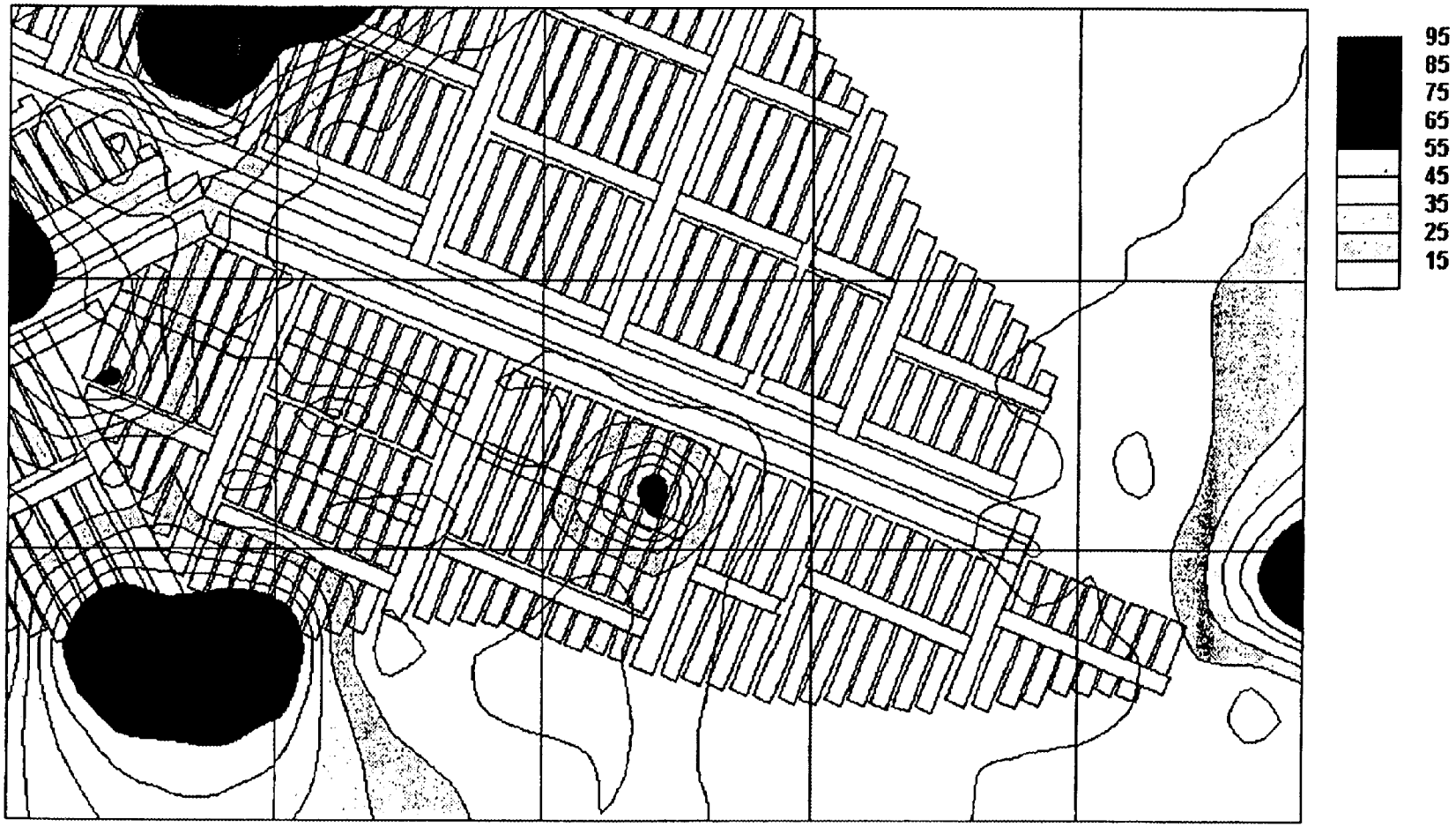
FIG. 15 is a quantitative mapping of interbedded shale with standstone rating.
Figure 16:
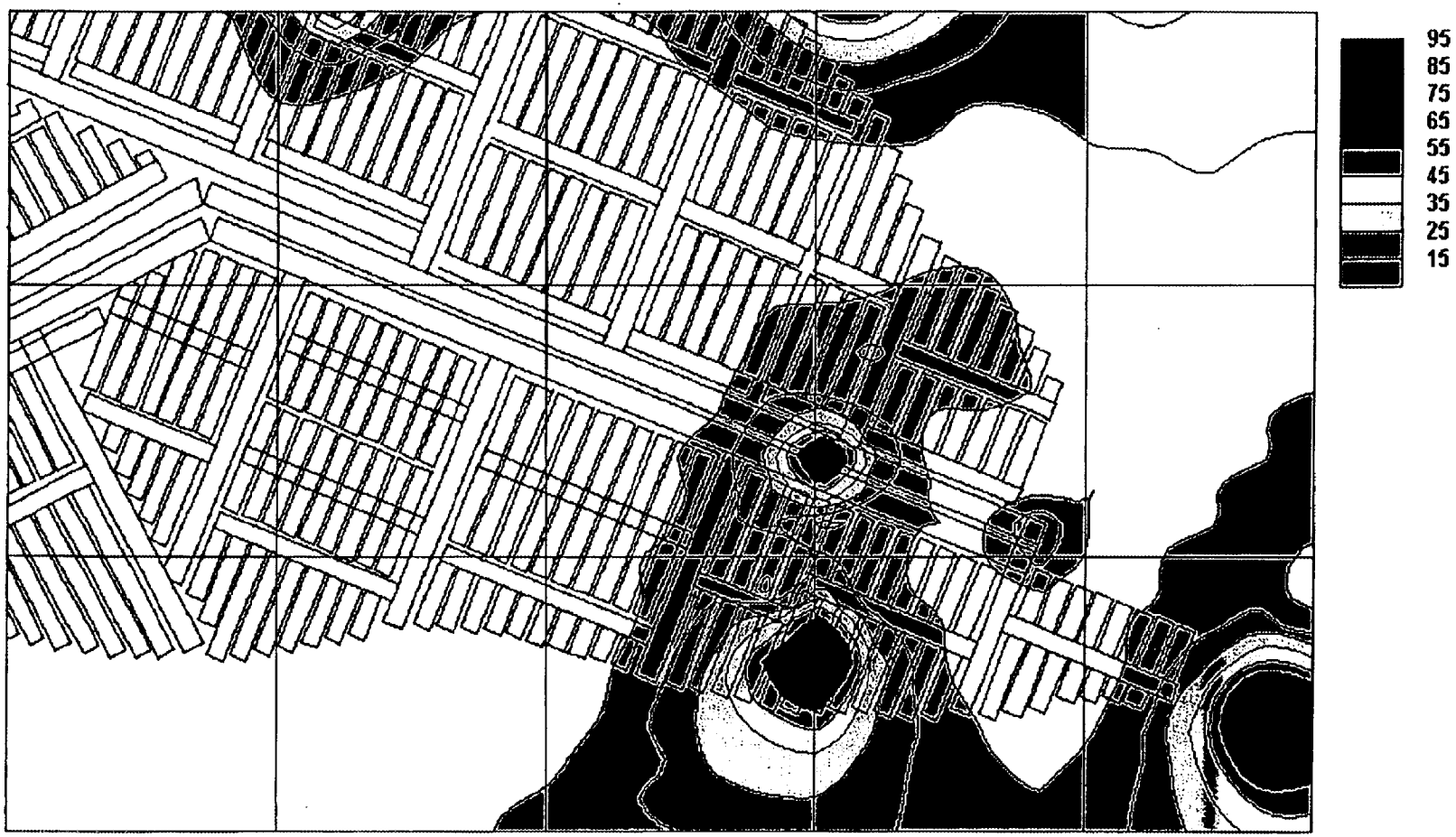
FIG. 16 is a quantitative mapping of sandstone with shale streak rating.

To identify possible roof problem areas and design proper roof support, the second roof instability rating (RIR) was applied based on the core hole logs provided and finite element analysis computer modeling. A total of 130 drill-hole logs (more than 1000 pages) were analyzed. Based on the drill hole logs, the SHR is shown in FIG. 13. It can be seen that most of the roof falls were in the high rating areas. The ISHWSSR is shown in FIG. 15. The SSWSHSR is shown in FIG. 16.

Figure 17:
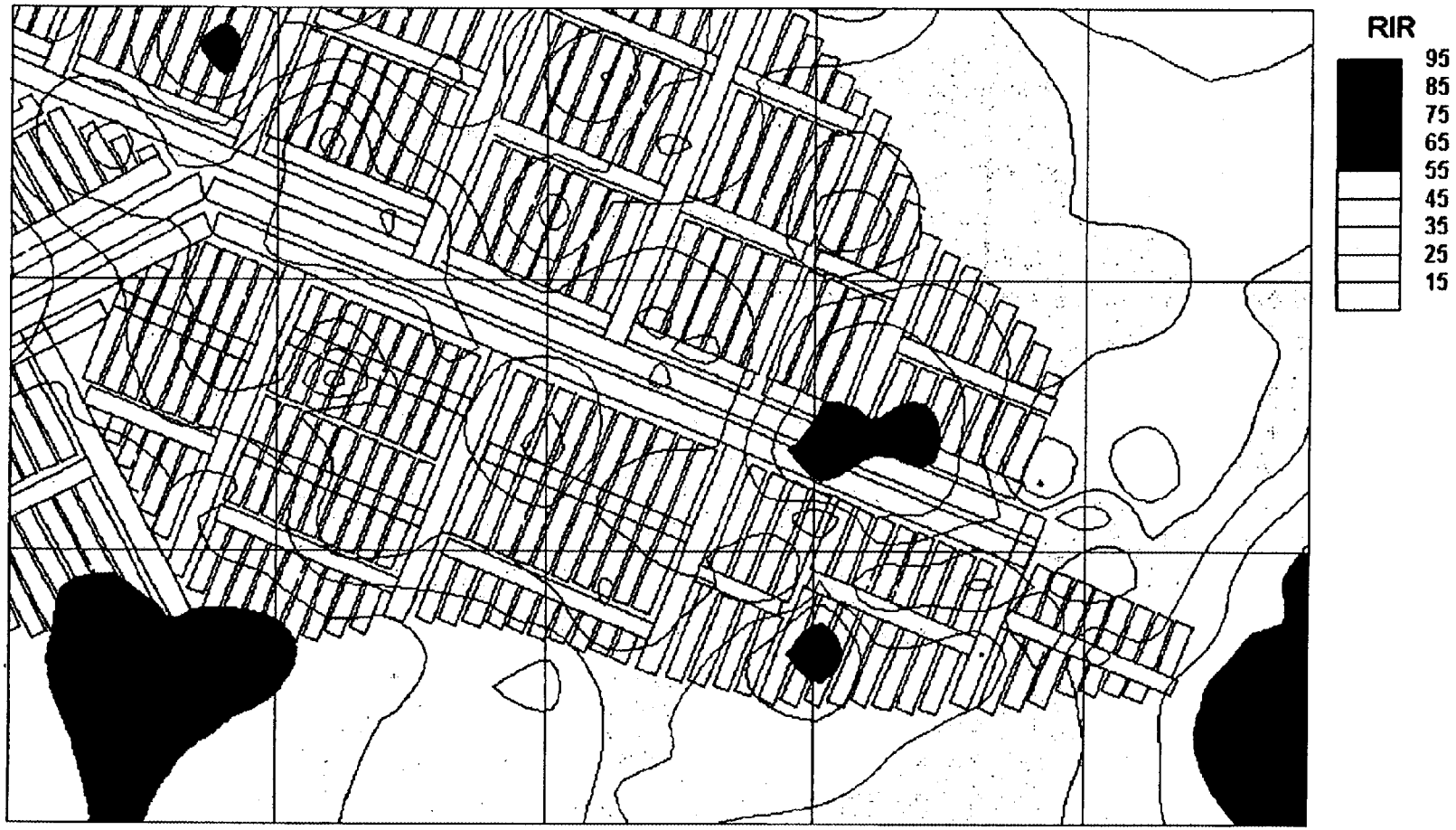
FIG. 17 is a quantitative mapping of a roof instability rating.

FIG. 17 shows the results of the second embodiment RIR as applied to the mine, with $W_1=4$, $W_2=1$, $W_3=2$, and $W_3=3$. It can be seen that the site is in a high RIR zone. The majority of roof falls occurred in areas where the RIR was greater than thirty-five. In the areas where the RIR was less than thirty-five, the roof was generally in good condition and the roof was less laminated. Use of six foot, non-tensioned, fully grouted bolts was successful.

As discussed in great detail above, the present invention may be used to predict mine roof instability so that support may be added before a mine roof fall occurs.

We claim:

1. A method for determining the stability of a mine roof comprising the steps of:

(a) identifying influence factors that affect mine roof instability;

(b) quantifying each influence factor;

(c) multiplying each influence factor by a numeric eight factor to obtain a weighted influence factor for each influence factor; and (d) determining a mine roof instability rating based on the weighted influence factors, wherein the influence factors are selected from the group consisting of a sandstone factor comprising a mica factor, a sandstone with shale streak factor, regional horizontal stresses, localized horizontal stresses, vertical stresses, a stream valle factor, tectonic stresses, a shale factor comprising a shale with sandstone streak factor, an interbedded shale with sandstone factor and a sandstone with shale streak factor.

2. The method according to claim 1, further comprising the step of determining a degree of supplemental support needed in areas where the mine roof instability rating shows increased risk of mine roof failure.

3. The method as claimed in claim 1, wherein quantifying each influence factors is accomplished through a step selected from the group comprising producing a finite element model, evaluating a core sample, and evaluating a surface topography map.

4. The method according to claim 1, wherein the step of weighting each influence factor is accomplished by multiplying each influence factor by a numerical value that represents an impact of the respective influence factor in overall roof instability.

5. The method according to claim 4, wherein the role of the respective influence factor in overall roof instability is determined by a step elected from the group comprising observing mine roof conditions, evaluating actual mine roof failures, determining mine roof composition, and applying knowledge gained from other mine roof failures.

6. The method according to claim 1, wherein the step of determining a mine roof instability rating (RIR) based on the weighted influence factors is calculated according to the equation $$RIR = \frac{\Sigma(W_i * FR_i)}{\Sigma W_i}$$

wherein $W_i$ is a numeric weight factor that individually corresponds to one of the influence factors and $FR_i$ is an influence factor.

7. The method according to claim 6, wherein the influence factors are selected from the group comprising a mica rating, a sandstone rating, a stream valley rating, and a tectonic stress rating.

8. The method according to claim 7, wherein the mica rating is equal to 100 in the presence of mica and the mica rating is zero in the absence of mica.

9. The method according to claim 7, wherein the sandstone rating (SR) is a combination of a sandstone thickness rating (STR) and sandstone interval rating (SIR), calculated by the equation $SR=(STR \times SIR)^{1/2}$, with STR=100 for a sandstone thickness greater than about twenty feet, STR=100*T/20 for a sandstone thickness of about twenty feet or less, SIR=100*(20−I)/20 when the interval I between the sandstone and coal seam is less than about twenty feet, and SIR=0 when I is at least about than twenty feet.

10. The method according to claim 7, wherein the stream valley rating is 100 within a zone of influence by a stream and the stream valley rating is zero outside of a zone of influence by a stream.

11. The method according to claim 7, further comprising the step of performing a finite element analysis to determine the tectonic stress rating, wherein the tectonic stress rating is 100 within a zone of tectonic influence and the tectonic stress rating is zero outside of a zone of tectonic influence.

12. The method according to claim 1, wherein the step of determining a mine roof instability rating based on the weighted influence factors is calculated by the mathematical equation $$RIR = \frac{(W_1 * SR) + (W_2 * MR) + (W_3 * SVR) + (W_4 * TSR)}{W_1 + W_2 + W_3 + W_4}$$

where SR is a sandstone rating and is a combination of a sandstone thickness rating (STR) and sandstone interval rating (SIR), calculated by the equation $SR=(STR \times SIR)^{1/2}$, with STR=100 for a sandstone thickness greater than about twenty feet, STR=100*T/20 for a sandstone thickness of about twenty feet or less, SIR=100*(20−I) 20 when the interval I between the sandstone and coal seam is less than about twenty feet, and SIR=0 when I is at least about than twenty feet, MR is a mica rating and is equal to 100 in the presence of mica and the mica rating is zero in the absence of mica, SVR is a stream valley rating and is 100 within a zone of influence by a stream and the stream valley rating is zero outside of a zone of influence by a stream, and TSR is a tectonic stress rating which is determined by finite element analysis wherein the tectonic stress rating is 100 within a zone of tectonic influence and the tectonic stress rating is zero outside of a zone of tectonic influence.

13. The method according to claim 1, wherein the step of determining a mine roof instability rating based on the weighted influence factors is calculated by the mathematical equation $$RIR = \frac{W_1 * SHR + W_2 * SHWSSR + W_3 * ISHWSSR + W_4 * SSWSHSR}{(W_1 + W_2 + W_3 + W_4)}$$

where SHR is a shale rating, SHWSSR is a shale with sandstone streak rating, ISHWSSR is an interbedded shale with sandstone rating, SSWSHSR is a sandstone with shale streaks rating, and $W_1$–$W_4$ are weighting factors.

14. The method according to claim 13, wherein the shale rating (SHR) includes a shale thickness rating (SHTR) and a shale interval rating (SHIR) between the shale and roof line, with the shale thickness rating (SHTR) defined as SHTR 100*((10−T)/10), where T is shale thickness, the shale interval rating (SHIR) defined as SHIR=100*(I/10), where I is the interval between the shale and the roof line, and the shale rating (SHR) defined as SHR=(3*SHTR+SHIR)/4.

15. The method according to claim 13, where the shale with sandstone streak rating (SHWSSR) includes thickness rating (TR) and an interval rating with, the thickness rating (TR) defined as TR100*(T/10), where T is the thickness of shale with sandstone streaks, the interval rating (IR) defined as IR=100*(10−I)/10, where I is the interval between the shale and the roof line, and the shale with sandstone streak rating (SHWSSR) is defined as $SHWSSR=(TR*IR)^{1/2}$.

16. The method according to claim 13, wherein the inter-bedded shale with sandstone rating (ISHWSSR) includes a thickness rating (TR) and interval rating (IR), with the thickness rating (TR) defined as TR=100*T/10, wherein T is the thickness of shale with sandstone streaks, the interval rating defined as IR=100*(10−I)/10, where I is the interval from the shale to the roof line, and the inter-bedded shale with sandstone rating is defined as $ISHWSR=(TR*IR)^{1/2}$.

17. The method according to claim 13, wherein sandstone with shale streaks rating includes (SSWSHSR) includes a thickness rating (TR) and interval rating (IR) with, the thickness rating (TR) defined as TR=100*T/10, wherein T is the thickness of shale with sandstone streaks, the interval rating (IR) defined as IR=100*(10−I)10, where I is the interval from the shale to the roof line, and the inter-bedded shale with sandstone rating (SSWSHSR) is defined as $SSWSHSR=(TR*IR)^{1/2}$.

18. A method for determining the stability of a mine roof comprising the steps of:

(a) identifying influence factors that affect mine roof instability;

(b) quantifying each influence factor, wherein quantifying each influence factors is accomplished through a step selected from the group comprising producing a finite element model, evaluating a core sample, and evaluating a surface topography map;

(c) multiplying each influence factor by a numeric eight factor to obtain a weighted influence factor for each influence factor; and (d) determining a mine roof instability rating based on the weighted influence factors.

19. A method for determining the stability of a mine roof comprising the steps of:

(a) identifying influence factors that affect mine roof instability;

(b) quantifying each influence factor;

(c) multiplying each influence factor by a numeric weight factor to obtain a weighted influence factor for each influence factor; and (d) determining a mine roof instability rating based on the weighted influence factors, wherein the step of determining a mine roof instability rating (RIR) based on the weighted influence factors is calculated according to the equation $$RIR = \frac{\Sigma(W_i * FR_i)}{\Sigma W_i}$$

wherein $W_i$ is a numeric weight factor that individually corresponds to one of the influence factors and $FR_i$ is an influence factor.

20. A method for determining the stability of a mine roof comprising the steps of:

(a) identifying influence factors that affect mine roof stability;

(b) quantifying each influence factor;

(c) multiplying each influence factor by a numeric eight factor to obtain a weighted influence factor for each influence factor; and (d) determining a mine roof instability rating based on the weighted influence factors, wherein the step of determining a mine roof instability rating based on the weighted influence factors is calculated by the mathematical equation $$RIR = \frac{W_1 * SHR + W_2 * SHWSSR + W_3 * ISHWSSR + W_4 * SSWSHSR}{(W_1 + W_2 + W_3 + W_4)}$$

where SHR is a shale rating, SHWSSR is a shale with sandstone streak rating, ISHWSSR is an interbedded shale with sandstone rating, SSWSHSR is a sandstone with shale streaks rating, and $W_1$–$W_4$ are weighting factors.

* * * * *

UNITED STATES PATENT AND TRADEMARK OFFICE

CERTIFICATE OF CORRECTION

PATENT NO. : 6,832,165 B2
DATED : December 14, 2004
INVENTOR(S) : Stankus et al.

It is certified that error appears in the above-identified patent and that said Letters Patent is hereby corrected as shown below:

Column 8,
Line 33, "numeric eight" should read -- numeric weight --
Line 41, "a stream valle" should read -- a stream valley --

Column 9,
Line 54, "(20-I) 20" should read -- (20-I)/20 --

Signed and Sealed this

Thirty-first Day of May, 2005

JON W. DUDAS
*Director of the United States Patent and Trademark Office*